United States Patent [19]

Tanazawa et al.

[11] Patent Number: 4,711,584

[45] Date of Patent: Dec. 8, 1987

[54] MOVEMENT OF ELECTRONIC WATCH OF ANALOG DISPLAY TYPE

[75] Inventors: Masayoshi Tanazawa, Tokyo; Masaru Shoji, Saitama; Wataru Yamada, Tokyo, all of Japan

[73] Assignee: Casio Computer Co., Ltd., Tokyo, Japan

[21] Appl. No.: 865,189

[22] Filed: May 19, 1986

[30] Foreign Application Priority Data

Jun. 24, 1985 [JP] Japan ..... 60-94371[U]

[51] Int. Cl.[4] ..... F04C 23/02

[52] U.S. Cl. ..... 368/88; 368/323

[58] Field of Search ..... 368/322, 323, 324, 327, 368/76, 156, 160, 88

[56] References Cited

FOREIGN PATENT DOCUMENTS 2006093 5/1979 United Kingdom .
2704350 10/1981 United Kingdom .
2085621 4/1982 United Kingdom .
2127991 4/1984 United Kingdom .

*Primary Examiner*—Bernard Roskoski
*Attorney, Agent, or Firm*—Frishauf, Holtz, Goodman & Woodward

[57] ABSTRACT

A movement of an electronic watch of analog display type is disclosed, which comprises a base plate made of a synthetic resin, a bearing plate made of a synthetic resin, and facing and spaced apart at a predetermined distance by a spacer from the baseplate and a step motor mounted on the baseplate, and including a rotor, a stator, and a coil. The rotation of the rotor of the motor is transmitted to hands, e.g., minute hand, through a gear train consisting of a plurality of gears, including those journaled between the baseplate and bearing plate. The gear train is made of a synthetic resin.

14 Claims, 8 Drawing Figures

MOVEMENT OF ELECTRONIC WATCH OF ANALOG DISPLAY TYPE

BACKGROUND OF THE INVENTION

This invention relates to a movement for an electronic watch of analog display type, for displaying the time with hands.

In the movement of a prior art electronic watch of analog display type, various components such as the baseplate, bearing plate, and gears are made of metal, so that their processibility is inferior. In addition, where gear wheels are made of metal, it is necessary to produce the gear wheel, body, and pinion by machining separately. This increases the number of components, reduces ease of assembly and increases the cost. Further, the weight of the movement is increased.

SUMMARY OF THE INVENTION

The object of the invention is to provide a movement for an electronic watch of analog display type, which permits ready processing of components, has much greater ease of assembly and thus permits reductions in cost and weight.

DETAILED DESCRIPTION OF THE PREFERRED EMBODIMENTS

Now, an embodiment of the invention will be described with reference to the drawings.

Figure 1:
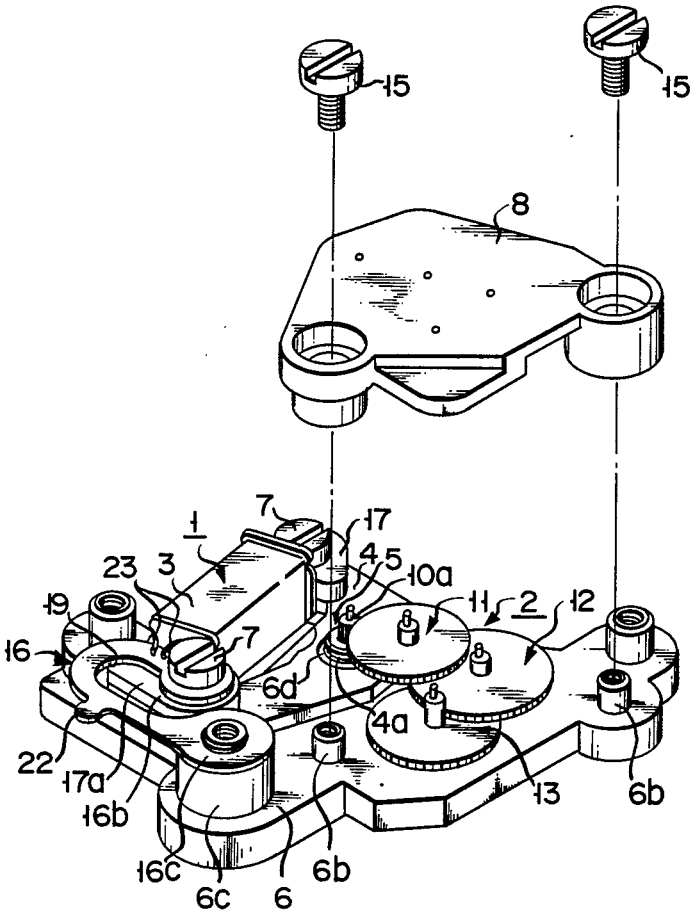
FIG. 1 is an exploded perspective view showing an embodiment of the movement for an electronic watch of analog display type.
Figure 2:
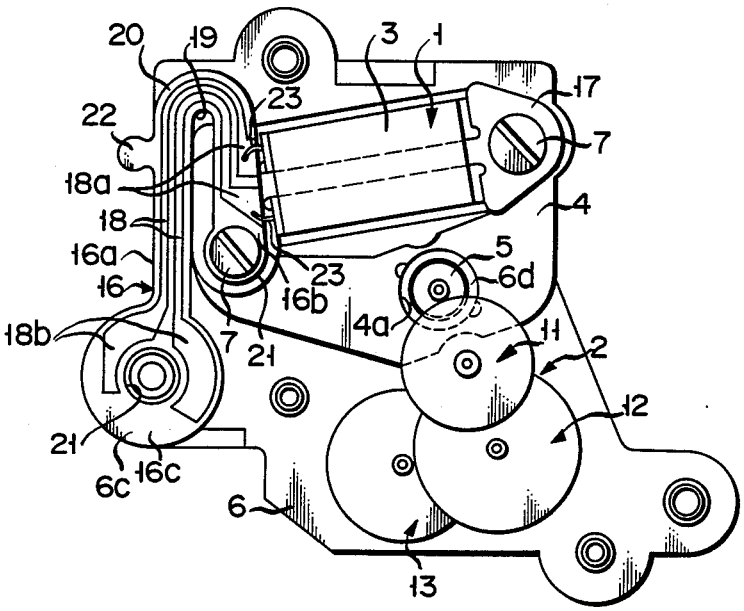
FIG. 2 is a plan view showing the movement shown in FIG. 1.
Figure 3:
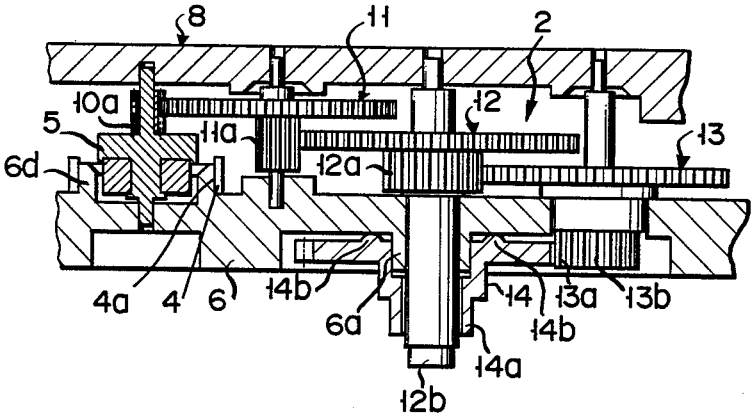
FIG. 3 is a sectional view showing the movement shown in FIG. 1.

FIGS. 1 to 3 illustrate a movement of an electronic watch of analog display type embodying the invention. The movement illustrated is of the two-hand type. It comprises step motor 1 and gear train 2. Step motor 1 drives gear train 2, which in turn drives the hands (not shown) to display the time. Step motor 1 includes coil 3, stator 4 and rotor 5. Rotor 5 is turned by one half rotation every time a pulse signal is supplied to coil 3. Step motor 1 is mounted by screws 7 on baseplate 6. Rotor 5 is located in circular hole 4*a* of stator 4. Its upper and lower ends are journaled in baseplate 6 and bearing plate 8, respectively. Cylinder projection 6*d* of baseplate 6 is fitted into circular hole 4*a* of stator 4 to locate stator 4.

Figure 4:
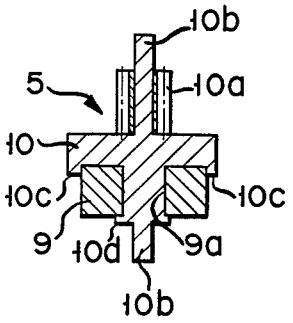
FIG. 4 is a sectional view showing a rotor in the movement.
Figure 5:
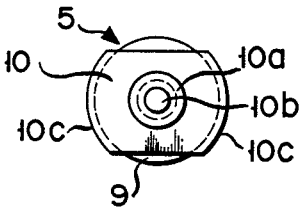
FIG. 5 is a plan view showing the rotor shown in FIG. 4.

FIGS. 4 and 5 show rotor 5. Rotor 5 consists of rotor body 10 and ring-like magnet 9. Magnet 9 is secured in rotor body 10 at the time of formation of a gear section of the rotor. Rotor body 10 is a one-piece resin molding having pinion 10*a* and shaft portion 10*b*. Rotor 5, except for magnet 9, is made of a material composed of nylon system and acetal system resins, containing reduced potassium titanate whisker introduced as a reinforcing agent.

Rotor body 10 has frame portion 10*c* for holding one end of magnet 9, and stopper 10*d* for retaining magnet 9 against detachment. Rotor body 10 of rotor 1 is molded by forcing a synthetic resin material into a die with magnet 9 set therein in advance. Thus, simultaneous with the molding of rotor body 10, the resin material is introduced into inner space 9*a* of magnet 9, whereby molded rotor body 10 and magnet 9 become integral.

If necessary, suitable indentations or the like may be provided on the coupled surfaces of rotor body 10 and magnet 9, whereby the two parts may be more firmly coupled together to prevent their relative rotation.

Gear train 2 serves to transmit the rotation of rotor 5 to the hands (not shown). As shown in FIG. 1, it includes first to fourth gear wheels 11 to 14. Second gear wheel 12 is a minute hand gear wheel, and fourth gear wheel 14 is an hour hand gear wheel. First to third gear wheels 11 to 13 are journaled between baseplate 6 and bearing plate 8. Fourth gear wheel 14 is located on the lower side of baseplate 6. First gear wheel 11 rotates in mesh with pinion 10*a* of rotor 5. Second gear wheel 12 rotates in mesh with pinion 11*a* of first gear wheel 11, as shown in FIG. 3. Its shaft projects as minute hand shaft 12*b* from the lower side of baseplate 6. A minute hand (not shown) is installed on the projecting lower end of shaft 12*b*. Third gear wheel 13 rotates in mesh with pinion 12*a* of second gear wheel 12, and its rotation is transmitted to fourth gear wheel 14. Its shaft 13*b* projects through baseplate 6 and has pinion 13*a* located on the projecting lower end. Fourth gear wheel 14 rotates in mesh with pinion 13*a* of third gear wheel 13. Minute hand shaft 12*b* of second gear wheel 12 is fitted in fourth gear wheel 14. Fourth gear wheel 14 is journaled on bearing portion 6*a* of baseplate 6. An hour hand (not shown) is installed on lower end 14*a* of fourth gear wheel 14. Bearing plate 8 is positioned on posts 6*b* provided on base plate 6 and secured thereto by screws 15.

As has been shown, when producing a rotor consisting mainly of a resin material, the magnet is made integral during the formation of a gear section. Therefore, deviation of the axis of the gear section and the axis of the ring-like magnet relative to each other never occurs. The alignment precision thus can be greatly improved. In addition, the gear section can be integrated without the need to pressure fit the magnet. Therefore, unlike the case of the prior art, there is no possibility of occurrence of a rejected rotor due to damage caused to the pressure fitted magnet. Further, the gear section side frame portion, for holding the magnet, has a shape capable of maintaining the balance of the rotor when the rotor is rotated. The rotor thus can be rotated stably. This frame portion holds one end of the magnet. Thus, when setting the magnet in a die, it will be properly secured inside the die cavity and core.

Further, since the frame portion for holding one end of the magnet faces the pinion gear, it will never be broken by occasional contact with the gear meshing with the pinion.

Gear wheel 14 is held in contact with baseplate 6 by a plurality of protuberances 14*b* formed on its flat surface.

Thus, frictional resistance between the two contact surfaces can be greatly reduced. Therefore, according to the invention, it is possible to obtain very smooth movement of gear wheels and prevent reduction of rotor torque in the movement.

Reference numeral 16 in FIG. 2 denotes a flexible base with two ends 16*b* and 16*c*. End 16*b* is secured together with end 17*a* of coil core 17 by screw 7 to baseplate 6. Other end 16*c* is assembled without excessive force on post 6*c* of baseplate 6, as shown in FIG. 1. On post 6*c*, an electronic circuit board (not shown), for supplying a drive signal to coil 3, is also assembled to face end 16*c*.

Flexible base 16 has flexible, sheet-like insulating member 16*a* provided on one side. Electrode leads 18 are formed on insulating member 16*a*. Flexible base 16 has a curved or folded shape like a "J" shape. Leads 18 have terminal portions 18*a* and 18*b*, and at ends 16*b* and 16*c* of flexible base 16, insulating member 16*a* is formed with mounting holes 21 close to terminal portions 18*a* and 18*b*.

Insulating member 16*a* has tongue-like engagement portion 22, which serves to guide leads 23 to connect (i.e., solder) with terminal portions 18*a* and also to temporarily secure the ends of these leads.

In the above embodiment, the curved flexible base is used for the connection between the coil section and electronic circuit section. Therefore, although the coil section and electronic circuit section are in the vicinity of each other, the flexible base can be flexed very gently due to its curved shape.

Besides, the flexing of the base is produced by a slight difference in level between the assembly positions of the two terminal sections. The flexible base thus can be assembled without causing undue flexing or distortion of the electrode leads on the surface. The flexible base thus has extremely high durability with respect to long use, so that is possible to provide a stable product. Further, since no forced flexing is required at the time of assembly, ease of assembly can be improved. Further, versatility can be improved to accommodate an increased variety of modules.

Baseplate 6 and bearing plate 8 can be made from any one of four different materials, i.e. PPS (polyphenylene sulfide) containing glass fiber; PPS containing glass fiber and polyamide; polysulfon containing glass fiber and polyether sulfon containing glass fiber.

Of these four materials, the second mentioned material has satisfactory wear-resistance properties and durability due to its polyamide content. Thus, it can increase the wear-resistance properties and strength of the bearing sections of baseplate 6 and bearing plate 8, and permits trouble free mounting of metal posts through pressure fitting, without the possibility of crack formation. Further, warping can be reduced by appropriately setting the thicknesses of various portions of the baseplate and bearing plate. The baseplate and bearing plate can thus be formed very precisely, making possible improvements in productivity.

The third and fourth materials mentioned above have satisfactory thermal creep properties. That is, when pressure is applied to them under high temperature conditions, they experience less deformation; so it is possible to eliminate looseness of bolts for example. Further, high tenacity can be achieved. Thus, the metal posts can be mounted easily through pressure fitting, without the possibility of crack formation. Further, since material tenacity is high, burrs are less liable to result at the time of molding, and it is possible to obtain precise molding, and thus improve productivity. The filler of the above materials is not limited to glass fiber; it is also possible to incorporate carbon, potassium titanate whisker, reduced potassium titanate whisker, etc.

The table below illustrates the mechanical characteristics of the second to fourth materials noted above.

| | Polysulfon | Polyether sulfon | Polyphenylene sulfide polyamide |
|---|---|---|---|
| Glass fiber content (%) | 30% | 30% | 45% |
| Tensile strength ($kg/cm^2$) | 1,260 | 1,400 | 1,200 |
| Elongation (%) | 3 | 3 | 1.5 |
| Bending strength ($kg/cm^2$) | 1,680 | 1,000 | 2,000 |
| Bending elasticity ($kg/cm^2$) | 84,000 | 124,000 | 150,000 |
| Izot inpact (kg · cm/cm) | 9.8 | 8.3 | 9.5 |

Gear wheels 11 to 14 of gear train 2 are made of a material composed of a resin of nylon system, acetal system, etc. and containing reduced potassium titanate whisker incorporated as a reinforcing agent. Reduced potassium titanate has the same mechanical properties as potassium titanate and permits an increase in mechanical strength. Also, it has electric conductivity and can prevent charging by static electricity.

Figure 6:
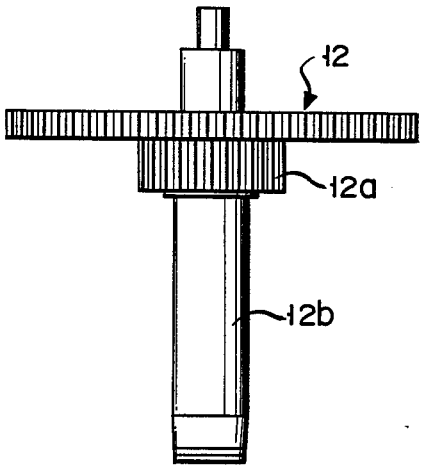
FIG. 6 is an enlarged-scale side view showing a second gear wheel.
Figure 7:
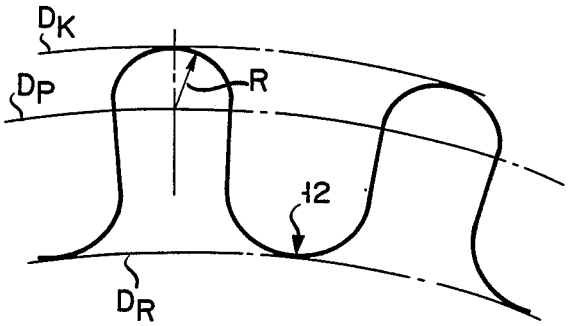
FIG. 7 is an enlarged-scale plan view showing an essential part of the gear of the second gear wheel.
Figure 8:
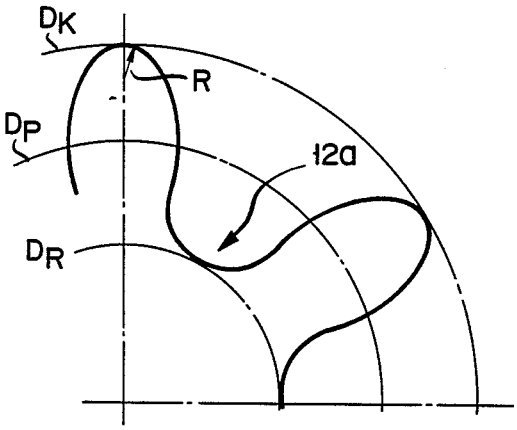
FIG. 8 is an enlarged-scale plan view showing an essential part of a pinion of the second gear wheel.

Of gear wheels 11 to 14 of gear train 2, second gear wheel 12, for instance, has a structure as shown in FIGS. 6 to 8. The gear of second gear wheel 12 in mesh with pinion 11*a* of first gear wheel 11, as shown in FIG. 7, has pitch line Dp with a diameter of 3.9 mm, deddendum circle Dr with a diameter of 3.692 mm and an addendum circle Dk with a diameter of 3.992 mm. Its tooth number Z is 60, and its module M (defined as a ratio between a pitch line with a diameter and the tooth number); is 0.065, which is the same as that of pinion 11*a* of first gear wheel 11. The top of its teeth has a diameter R of 0.0459 mm. This diameter is at least 0.4 times that of module M (in the present case 0.706 times). Pinion 12*a* of second gear wheel 12, as shown in FIG. 8, has pitch line Dp with a diameter of 1.150 mm, deddendum circle Dr with a diameter of 0.874 mm, and an addendum circle Dk with a diameter of 1.403 mm. Its tooth number Z is 10 and module M is 0.115, the same as that of third gear wheel 13. The top of its teeth has a diameter R of 0.046 mm, which is 0.4 times that of module M. This type of second gear wheel 12, made from a synthetic resin can be fabricated using a molding die which is produced by a wire discharge process. Wire of thickness (diameters) 0.05 mm and 0.03 mm can be used for the wire discharge process. When using 0.05 mm wire, and where the discharge gap is 0.005 mm, the minimum radius is 0.03 mm, and the minimum obtainable module M of the gear, in this instance. When using 0.03 mm wire, and where the discharge gap is 0.005 mm, the minimum radius is 0.02 mm, and the minimum obtainable module M of the gear, in this instance, is 0.05. Thus, the molding die for producing second gear wheel 12 may be produced satisfactorily and very precisely by the wire discharge process. Second gear wheel 12 can thus be produced easily and satisfactorily, permitting improvement in productivity.

Gear wheels 11 to 14 may have different colors; for instance first gear wheel 11 may be red, second gear wheel 12 gray, third gear wheel 13 blue and fourth gear wheel 14 black. This will facilitate the assembling operation, and the worker can correctly and quickly assemble the gear train. In addition, the inspector can immediately confirm that a right-hand gear wheel is assembled in the right-hand position in the gear train.

In particular, second gear wheel 12, inclusive of minute hand shaft 12*b* with its top surface projected from the face of a watch may be colored the same as the minute hand, by use of a pigment, during the molding process. For example, where the minute hand is nickel-plated and has a silver color, second gear wheel 12, with its shaft 12*b*, may be made gray, a color of the same system. Where each hand is a gold-plated one and has a gold color, second gear wheel 12 with its shaft 12*b* may be made yellow, a color of the same system. With second gear wheel 12 and its shaft 12*b* made gray, a black hand does not seem so different in color.

With minute hand shaft 12, (which appears at the top), given a color of the same system as that of the minute hand, no substantial color difference can be noted, and the hand and hand shaft will seem integral, which is desirable from the standpoint of design and appearance.

In the above embodiment, pigments are incorporated when molding second gear wheel 12 as the minute hand gear wheel, and fourth gear wheel as the hour hand gear wheel. However, this is by no means limitative, and gear wheels 12, after molding, may be coated with paint. In this case, paint need not be coated on the entire surfaces of gear wheels 12, but may be coated only on portions of shafts 12*a* and 14*a* which are exposed. In particular, paint may be coated only on the top of minute hand shaft 12*b*. A better outer appearance is obtained if fourth gear wheel 14 with the four hand mounted thereon is painted with the same color as that of the hour hand. While the above embodiment is concerned with a two-hand type analog movement, the invention is of course also applicable to a three-hand type analog movement. Further, the invention is applicable not only to electronic watches but also to other timepieces.

What is claimed is:

1. A movement of an electronic watch of analog display type comprising:

a baseplate made of a synthetic resin;

a step motor mounted on said baseplate and including a rotor, a stator and a coil;

a bearing plate made of a synthetic resin and facing and spaced apart at a predetermined distance from said synthetic resin baseplate; and a gear train consisting of a plurality of gears including gears journaled between said baseplate and bearing plate to transmit the rotation of said rotor of said motor to hands; said gears of said gear train being made of synthetic resin, the teeth of said gears being formed in an arc, and the radius of a top of the teeth of each of said gears is at least 0.4 times that of a module M defined by the relationship M=diameter of pitch line/divided by number of teeth.

2. A movement according to claim 1, wherein adjacent said gears have different colors.

3. A movement according to claim 2, wherein said plurality of gears all have different colors.

4. A movement according to claim 1, wherein gears with hands mounted thereon among said plurality of gears each have the same color as the corresponding hand.

5. A movement according to claim 1, wherein at least one of said gears is made of a resin material containing whisker of reduced potassium titanate.

6. A movement according to claim 5, wherein said resin material is polyacetal.

7. A movement according to claim 1, wherein said baseplate and said bearing plate are made of a resin containing polyphenylene sulfide, polyimide, and a filler.

8. A movement according to claim 7, wherein said filler is glass fiber.

9. A movement according to claim 1, wherein said baseplate and said bearing plate are made of a resin material containing polysulfon, and a filler.

10. A movement according to claim 9, wherein said filler is glass fiber.

11. A movement according to claim 1, wherein said baseplate and bearing plate are made of a resin material composed of polyether, and a filler.

12. A movement according to claim 11, wherein said filler is glass fiber.

13. A movement according to claim 1, wherein said rotor of said step motor includes a rotor magnet, a shaft portion journaled between said baseplate and said bearing plate and a pinion, and is made of a synthetic resin except for said rotor magnet.

14. A movement according to claim 1, wherein said stator of said step motor has a hole for accommodating said rotor, said baseplate having a cylindrical projection fitted in said hole.

* * * * *